US007172659B2

(12) United States Patent
Tomizawa et al.

(10) Patent No.: US 7,172,659 B2
(45) Date of Patent: Feb. 6, 2007

(54) METHOD FOR PRODUCING QUENCHED R-T-B—C ALLOY MAGNET

(75) Inventors: Hiroyuki Tomizawa, Hirakata (JP); Koji Nakahara, Ibaraki (JP); Yuji Kaneko, Uji (JP)

(73) Assignee: Neomax Co., Ltd., Osaka (JP)

( * ) Notice: Subject to any disclaimer, the term of this patent is extended or adjusted under 35 U.S.C. 154(b) by 360 days.

(21) Appl. No.: 10/481,025

(22) PCT Filed: Jun. 24, 2002

(86) PCT No.: PCT/JP02/06311

§ 371 (c)(1),
(2), (4) Date: Dec. 17, 2003

(87) PCT Pub. No.: WO03/003392

PCT Pub. Date: Jan. 9, 2003

(65) Prior Publication Data

US 2004/0168746 A1 Sep. 2, 2004

(30) Foreign Application Priority Data

Jun. 27, 1907 (JP) ..... 2001-193918

(51) Int. Cl.
*H01F 1/053* (2006.01)
*H01F 1/057* (2006.01)
*H01F 1/058* (2006.01)

(52) U.S. Cl. ..... 148/101; 148/302
(58) Field of Classification Search ..... None
See application file for complete search history.

(56) References Cited

U.S. PATENT DOCUMENTS 4,983,231 A * 1/1991 Yamanaka et al. ..... 148/301
6,319,334 B1 11/2001 Ohashi et al.

(Continued)

FOREIGN PATENT DOCUMENTS

CN 1127797 A 7/1996

(Continued)

OTHER PUBLICATIONS

Chun Long—Office Action dated Jan. 10, 2005 in Appln. No. 02801400.6.

*Primary Examiner*—John P. Sheehan
(74) *Attorney, Agent, or Firm*—Nixon Peabody LLP; Jeffrey L. Costellia

(57) ABSTRACT

The present invention is a production method of an R-T-B—C rare earth alloy (R is at least one element selected from the group consisting of rare earth elements and yttrium, T is a transition metal including iron as a main component, B is boron, and C is carbon). An R-T-B bonded magnet containing a resin component, or an R-T-B sintered magnet with a resin film formed on the surface thereof is prepared, and a solvent alloy containing a rare earth element R and a transition metal element T is prepared. Thereafter, the R-T-B bonded magnet is molten together with the solvent alloy. In this way, a rare earth alloy can be recovered from a spent bonded magnet or a defective one generated in a production process stage, and a rapidly quenched alloy magnet can be obtained. As a result, magnet powder is recovered from the R-T-B magnet, and the recycling of a magnet including a resin component can be realized.

15 Claims, 1 Drawing Sheet

U.S. PATENT DOCUMENTS

| | | | | |
|---|---|---|---|---|
| 6,533,837 | B1 * | 3/2003 | Yamagata et al. | 75/348 |
| 2003/0041920 | A1 * | 3/2003 | Hoshi et al. | 148/122 |

FOREIGN PATENT DOCUMENTS

| | | | |
|---|---|---|---|
| CN | 1223182 | A | 7/1999 |
| CN | 1261718 | A | 8/2000 |
| JP | 05-055018 | | 3/1993 |
| JP | 07-111208 | | 4/1995 |
| JP | 08-273959 | | 10/1996 |

* cited by examiner

METHOD FOR PRODUCING QUENCHED R-T-B—C ALLOY MAGNET

TECHNICAL FIELD

The present invention relates to a production method of an R-T-B—C rare earth alloy which is suitable for recycling a bonded magnet, and a production method of an R-T-B rare earth rapidly quenched alloy magnet manufactured by using the rare earth alloy.

BACKGROUND ART

Presently, R-T-B (R is at least one rare earth element including Y, T is a transition metal including iron as a main component, and B is boron) rare earth magnets are actively used in various fields as high-performance magnets. Reuse of R-T-B rare earth magnets by way of recycling is important not only in view of the assurance and effective use of the resources, but also in view of the reduction in production cost of the R-T-B rare earth magnets.

In the case of the R-T-B sintered magnet, grinding sludge and fine powder generated in the production processes have a strongly oxidizing characteristic, so that they may disadvantageously cause spontaneous firing in the atmosphere. Accordingly, treatment in which the sludge and the fine powder are intentionally oxidized by a process such as incineration, so as to change them into stable oxides is performed. Chemical treatment such as acid dissolution is performed for such oxides, so that rare earth elements can be separated and extracted.

As for a final product of an R-T-B sintered magnet, it is studied that recycling to an R-T-B material alloy by means of a technique such as remelting is performed.

In the case where a bonded magnet is recycled, magnetic powder and a binder resin in the bonded magnet may be separated, thereby recovering the magnetic powder. However, the resin in the bonded magnet contains a lot of carbon component, so that it is difficult to avoid the carbon in the resin from adhering to the magnetic powder, or depositing and sticking thereto. As a result, the magnetic powder recovered from the bonded magnet includes a lot of impurities of carbon. Thus, it is necessary to perform a process of removing the carbon. The process of removing the carbon greatly increases the production cost, so that the recycling of the rare earth bonded magnet is not practically performed yet. In the case where an R-T-B sintered magnet with a resin film formed on the surface thereof is to be recycled, the same problem as that of the R-T-B bonded magnet exists.

Japanese Laid-Open Patent Publication No. 5-55018 discloses a technique in which a defective or unnecessary bonded magnet is pulverized into powder, and the powder is directly utilized again as magnet powder for a bonded magnet. However, the magnet powder included in the bonded magnet is magnetized, so that the magnetic powder still keeps the magnetism in a condition without any treatment. Thus, there exists a problem that it is difficult to supply such magnet powder to a cavity for compacting.

Japanese Laid-Open Patent Publication No. 7-111208 discloses a technique in which an unnecessary bonded magnet is heated up to 700 to 1000° C. in a vacuum or in an inert gas, thereby demagnetizing magnet powder. However, the thermal treatment at 700 to 1000° C. results in the following problems. Crystal grains in the magnetic powder become bulky, so that the coercive force is largely lowered. In addition, a resin in the bonded magnet is carbonized.

On the other hand, in a known method, a resin component in the bonded magnet is dissolved by using a solvent, thereby taking out magnet powder only. This method involves a disadvantage that the solvent to be used is expensive. In addition, the magnetic powder obtained by this method is in a magnetized condition, similarly to the magnetic powder obtained by the method of Japanese Laid-Open Patent Publication No. 5-55018, so that it is necessary to additionally perform a demagnetizing process.

The present invention has been conducted in view of the above-described prior art. A main object of the present invention is to recover a magnet alloy from an R-T-B bonded magnet or an R-T-B sintered magnet with a resin film on the surface thereof by a method without requiring a demagnetizing process or a decarburizing process, thereby enabling the R-T-B bonded magnet to be recycled.

DISCLOSURE OF INVENTION

The production method of the R-T-B—C rare earth alloy according to the present invention is a method of an R-T-B—C rare earth alloy (R is at least one element selected from the group consisting of rare earth elements and yttrium, T is a transition metal including iron as a main component, B is boron, and C is carbon) including the steps of: preparing an R-T-B magnet containing a resin component; preparing a solvent alloy containing a rare earth element R and a transition metal element T; and melting the R-T-B magnet together with the solvent alloy.

In a preferred embodiment, the R-T-B magnet is an R-T-B bonded magnet and/or an R-T-B sintered magnet.

In a preferred embodiment, the R-T-B sintered magnet includes a resin film formed on the surface thereof.

In a preferred embodiment, the solvent alloy contains the rare earth element R of 0.5% or more and 50% or less by weight of the total of the alloy.

In a preferred embodiment, the solvent alloy contains B (boron) and/or C (carbon), and a total content of B (boron) and C (carbon) is 0.01% or more and 20% or less by weight of the total of the alloy.

In a preferred embodiment, the solvent alloy contains at least one additive element selected from the group consisting of Al, Si, P, S, Ti, V, Cr, Mn, Ni, Cu, Zn, Ga, Zr, Nb, Mo, In, and Sn.

In a preferred embodiment, the R-T-B magnet is recovered as a defective product generated in a production process, or a spent product.

In a preferred embodiment, the step of melting the R-T-B magnet together with the solvent alloy is performed in a vacuum or inert gas atmosphere by using a high-frequency induction melting method.

The production method of an R-T-B—C rare earth alloy according to the present invention includes the steps of: preparing an R-T-B magnet including powder of the R-T-B—C rare earth alloy produced by any one of the above-described production method; preparing a solvent alloy containing a rare earth element R and a transition metal element T; and melting the R-T-B magnet together with the solvent alloy.

The production method of an R-T-B—C rare earth rapidly quenched alloy magnet according to the present invention includes the steps of: preparing the R-T-B—C rare earth alloy produced by any one of the above-described production methods; preparing a molten alloy of the R-T-B—C rare earth alloy; and rapidly quenching the molten alloy, thereby producing a rapidly solidified alloy.

In a preferred embodiment, before the step of rapidly quenching the molten alloy of the R-T-B—C rare earth alloy, a rare earth element and/or a transition metal element is added to the R-T-B—C rare earth alloy.

In a preferred embodiment, before the step of rapidly quenching the molten alloy of the R-T-B—C rare earth alloy, B (boron) and/or C (carbon) is added to the R-T-B—C rare earth alloy.

In a preferred embodiment, before the step of rapidly quenching the molten alloy of the R-T-B—C rare earth alloy, a rare earth alloy is added to the R-T-B—C rare earth alloy.

In a preferred embodiment, the step of producing the rapidly solidified alloy includes a step of rapidly quenching the molten alloy by bringing the molten alloy into contact with a surface of a rotating cooling member.

The production method of a bonded magnet according to the present invention includes the steps of: preparing powder obtained by pulverizing the alloy for the R-T-B—C rare earth magnet produced by any one of the above-described production methods; and mixing the powder with a resin.

BEST MODE FOR CARRYING OUT THE INVENTION

Figure 1:
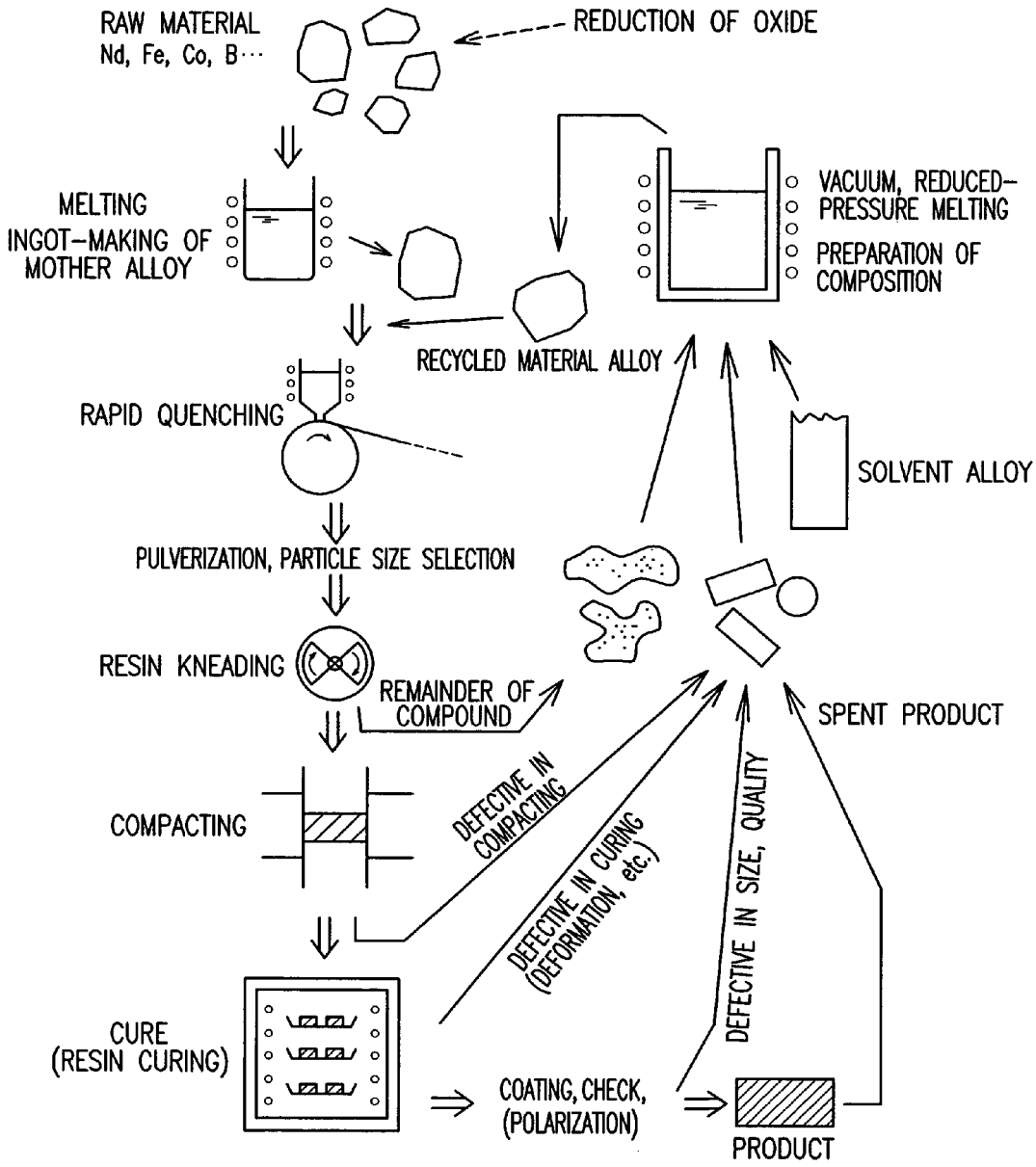
FIG. 1 is a diagram illustrating an embodiment of a production method of an R-T-B—C rare earth rapidly quenched alloy magnet according to the present invention.

In the present invention, R-T-B magnets obtained by recovering defective products generated in a production process or spent products are remolten (fused), so as to utilize them for the recycling of material alloys. The most characteristic point of the present invention resides in that, when an R-T-B bonded magnet or an R-T-B sintered magnet with a resin film formed on the surface thereof is to be remolten, a solvent alloy containing a rare earth element and a transition metal element is employed.

The amount of the rare earth element contained in the solvent alloy is preferably 0.5% or more and 50% or less by weight of the total of the alloy. The solvent alloy may contain B (boron) and/or C (carbon). The total content of B (boron) and C (carbon) is preferably 0.01% or more and 20% or less by weight of the total of the alloy. In the solvent alloy, a transition metal T including iron as a main component is contained at a ratio of not lower than 50% nor more than 95% by weight. The ratio of the rare earth element R to the transition metal T in the solvent metal (R:T) is preferably from 1:99 to 50:50.

The R-T-B magnet and the solvent alloy are mixed at the ratio from 5:95 to 80:20 by weight, and molten.

By the use of the solvent alloy, the R-T-B bonded magnet in which electric resistance is remarkably increased due to the existence of a resin component can be efficiently molten by a high-frequency induction melting method. In the case where the solvent alloy is not used, a clean molten alloy is not generated because of a lot of impurities such as carbon existing in the bonded magnet, and slugs disadvantageously occur. It is extremely difficult to separate such slugs from the molten alloy. In another case where the composition of the solvent alloy is greatly deviated from the composition of magnetic powder included in the bonded magnet, there may occur a case where, after the solvent alloy is molten with priority, the resin component of the bonded magnet is not dissolved in the molten alloy. Accordingly, the composition of the solvent alloy is preferably similar to the composition of the magnetic powder of the bonded magnet to be molten.

To the solvent alloy, at least one element selected from the group consisting of Al, Si, P, S, Ti, V, Cr, Mn, Ni, Cu, Zn, Ga, Zr, Nb, Mo, In, and Sn may be added.

The carbon dissolved into the molten alloy from the resin component of the bonded magnet can be substituted for part of boron of the rare earth/transition metal/boron magnet. In the case of a sintered magnet, it is known that the substitution of carbon for part of boron increases the corrosion resistance, but the substitution disadvantageously functions in view of the realization of high coercive force. However, according to the experiments of the inventors, it was found that since alloys obtained by a liquid quenching method such as melt spinning, a gas atomizing method, a quenching method such as strip casting, the structure had fine structures, the substitution of carbon for part of boron did not cause the deterioration of magnetic properties. Accordingly, even if carbon derived from the resin component is contained as the result of the above-described remelting of the bonded magnet, the carbon does not badly affect the final magnetic properties.

In addition, in the present invention, the above-described remelting is performed in a vacuum or an inert gas, so that much of the binder resin components (carbon, hydrogen, oxygen, nitrogen, chlorine, or the like) in the bonded magnet are removed. Specifically, carbon is dissolved into the molten alloy, and oxygen forms a slug as an oxide. The slug serves a function of capturing other unnecessary elements. Thus, when the slug is separated from the molten alloy, the unnecessary components in the binder resin can be removed from the molten alloy. A specific gravity of the slug is sufficiently smaller than a specific gravity of the molten alloy, so that the slug floats on the molten alloy. For this reason, it is easy to separate the slug from the molten alloy.

According to the above-described method, unnecessary resin components can be excluded from the bonded magnet, so that a rare earth alloy for which reducing treatment is not required can be recovered. In addition, since the rare earth alloy which is recovered in such a way is molten once, magnetization is not retained, and it is easy to treat the alloy after pulverization.

According to the present invention, part of carbon derived from the resin component of the bonded magnet is captured into the remolten alloy, and contained in the final R-T-B rare earth rapidly quenched alloy. However, the carbon exists in the fine structure of the rapidly quenched alloy, and hardly deteriorates the magnetic properties. It is understood that, in order to make the magnetic properties of the final magnet powder superior, a total content (B+C) of boron and carbon in the magnet powder is preferably set in a range of not lower than 0.5 wt % nor higher than 2.0 wt %, and the atomic number ratio of the carbon (C/(B+C)) is preferably set in a range of not lower than 0.05 nor higher than 0.75.

As for the magnet according to the present invention, it was ensured that the magnetic properties were at sufficiently superior level, and moreover the qualities such as weather resistance were superior.

One or more elements selected from the group consisting of Co, Ni, Mn, Cr, and Al may be substituted for part of Fe in the present invention. Alternatively, one or more elements selected from the group consisting of Si, P, Cu, Sn, Ti, Zr, V, Nb, Mo, and Ga may be added.

Next, an embodiment of the present invention will be described with reference to FIG. 1.

First, as for a production method of a bonded magnet, a known embodiment is described.

Raw materials such as Nd, Fe, Co, and B obtained by oxide reduction or other techniques are molten, thereby forming an ingot of mother alloy containing these elements. A molten alloy obtained by melting the mother alloy is cooled and solidified by a rapidly quenching method such as melt spinning and strip casting. Thereafter, pulverization and particle size classifying processes are performed, thereby obtaining magnet powders having a desired particle size distribution. A binder resin is mixed with the magnet powder, and a compound is produced. Thereafter, compaction is performed by using a pressing apparatus or the like. A curing process of the binder resin is performed for the mixture of the resin and the magnet powder having a desired shape. Thereafter, a final product is completed through coating and checking processes.

In the R-T-B magnet containing a resin component, in addition to the magnet produced by the above-described compression compacting, a magnet prepared by injection molding of a mixture (compound) of a resin and magnet powder, or a sintered magnet with a resin film formed on the surface thereof is included.

In the present invention, a spent bonded magnet after the magnet is produced by the above-described method and shipped as a product is recovered, and an R-T-B—C rare earth alloy is produced. At this time, the remainder of compound generated in the production process of the bonded magnet, a defective product in compacting, a defective product in curing, and the like can be recycled. In the present invention, when a spent bonded magnet is to be molten in a vacuum or a reduced pressure atmosphere, the above-mentioned solvent alloy is used. The magnet powder in the bonded magnet is remolten together with the solvent alloy, so as to generate a recycled material alloy including carbon in part. The recycled material alloy is fused and solidified by a rapidly quenching method such as a single roll method, and thereafter reproduced as a magnet powder for a bonded magnet again through the same processes as those in the above-described known production method. Then, the magnet powder is used for the production of a bonded magnet.

(Embodiment 1)

First, an epoxy resin was added at 2.0% by weight to a rare earth alloy magnet powder having a composition of 27.0 mass % of Nd, 4.6 mass % of Co, 0.96 mass % of B, and Fe as the remainder, and then the powder was compacted so as to have a predetermined shape by press compaction using a cavity. Thereafter, resin-curing treatment was performed, thereby manufacturing a magnetically isotropic bonded magnet.

The bonded magnet of 300 grams and an alloy ingot (a solvent alloy) having a composition of 29.6 mass % of Nd and Fe as the remainder were thrown into an alumina crucible in a melting chamber, so as to perform high frequency induction melting in a vacuum. In this way, the solvent alloy and the bonded magnet were molten together, thereby forming a molten alloy. By introducing an Ar gas into the melting chamber, a pressure in the melting chamber was returned to be 80 kPa, and in such a condition, a heating condition was held for 10 minutes.

The molten alloy was cast in a mold, and then cooled and solidified. Constituents of the thus-obtained ingot were analyzed. The analyzed results are shown in Table 1.

TABLE 1

| | Element | | | | | | | | | |
|---|---|---|---|---|---|---|---|---|---|---|
| | Nd | Pr | Fe | Co | Cu | Si | Al | B | O | C |
| Content Ratio (Mass %) | 28.3 | 0.20 | 66.5 | 1.47 | 0.06 | 0.08 | 0.35 | 0.97 | 0.03 | 0.35 |

Next, Nd and Fe were added to the alloy so as to have a composition of 27.1 mass % of Nd, 0.9 mass % of Co, 0.68 mass % of B, 0.34 mass % of C, and Fe as the remainder, and then the melting was performed again.

Thereafter, the molten alloy having the above-mentioned composition was rapidly quenched by a single roll method, thereby solidifying the alloy. The roll peripheral velocity was 20 m/sec. The thus-produced rapidly solidified alloy was subjected to thermal treatment at 600° C. for 20 minutes. Thereafter, the alloy was pulverized by means of a mortar, thereby producing magnet powder. The particle size of the powder was 150 μm or less. The magnetic properties of the powder (Embodiment 1) were measured by VSM (Vibrating Sample Magnetometer). The measured results are shown in Table 2.

Table 2 also shows magnetic properties of magnet powder (Comparative Example 1) produced by using respective materials of Nd, Fe, Co, B, and C, blending them so as to have the same composition as that of the above-mentioned embodiment, and performing the melting thereof, as a comparative example.

TABLE 2

| | $B_r$ (T) | $H_{cJ}$ (kA/m) |
|---|---|---|
| Embodiment 1 | 0.780 | 1180 |
| Comparative Example 1 | 0.762 | 1210 |

As is seen from Table 2, as for the residual magnetic flux density Br and the coercive force $H_{cJ}$, Embodiment 1 exhibits superior magnetic properties which compares advantageously with those of Comparative Example 1.

(Embodiment 2)

In this embodiment, the bonded magnet produced by using the magnetic powder of Embodiment 1 was remolten. Specifically, the bonded magnet produced by the remelting method was further remolten, thereby producing magnet powder of rapidly quenched alloy. For the purpose of comparison, a bonded magnet produced by using the magnetic powder of Comparative Example 1 was remolten.

The bonded magnets which were remolten were isotropic bonded magnets obtained by adding an epoxy resin of 2.0% by weight to magnet powders of Embodiment 1 and Comparative Example 1 having the composition of 27.1 mass % of Nd, 0.9 mass % of Co, 0.68 mass % of B, 0.34 mass % of C, and Fe as the remainder, respectively, and then compacting them by press compaction using a cavity so as to have a predetermined shape.

When the bonded magnets were to be remolten together with a solvent alloy, Nd, Fe, Co, B, and C were added so as to have the final composition of 27.1 mass % of Nd, 0.9 mass % of Co, 0.68 mass % of B, 0.34 mass % of C, and Fe as the remainder. Thereafter, molten alloys obtained from the above-described two kinds of bonded magnets were rapidly quenched by a single roll method, respectively, thereby solidifying them. For both of the rapidly solidified alloys, thermal treatment at 600° C. for 20 minutes was performed, and then they were pulverized, thereby producing magnet powders.

The magnetic properties of the magnet powders produced by the above-described methods are shown in Table 3.

TABLE 3

| | $B_r$ (T) | $H_{cJ}$ (kA/m) |
|---|---|---|
| Embodiment 2 | 0.782 | 1190 |
| Embodiment 3 | 0.776 | 1170 |

Herein, Embodiment 2 is magnet powder obtained by way of respective processes of remelting, fusing, rapidly solidifying, and pulverizing the bonded magnet produced by using the magnet powder of Embodiment 1. Embodiment 3 is magnet powder obtained by way of respective processes of remelting, fusing, rapidly solidifying, and pulverizing the bonded magnet produced by using the magnet powder of Comparative Example 1.

As is seen from Table 3, similarly to Embodiment 1, Embodiments 2 and 3 exhibit superior magnetic properties.

INDUSTRIAL APPLICABILITY

According to the present invention, by means of a remelting method using a solvent alloy, a magnet alloy can be efficiently taken out of a bonded magnet. In addition, since the magnet alloy taken out in this way is further subjected to processes of fusing and rapid solidification, an R-T-B—C rare earth magnet alloy in which magnetic properties are hardly deteriorated can be obtained even if carbon derived from a binder resin of the bonded magnet is contained.

As described above, according to the present invention, without performing reducing treatment, decarburizing treatment, a material alloy for a rare earth alloy magnet can be taken out of a bonded magnet. Thus, economic recycling of bonded magnets can be realized. In addition, the added carbon lowers the oxidizing reactivity of the rare earth magnet, so that the magnetic properties are not deteriorated and the safety of process steps is not inhibited by the heating or burning during the production process. Moreover, even if a special protecting film for improving the weather resistance is not provided on a surface of the magnet, it is possible to prevent the magnet from deteriorating with time.

The invention claimed is:

1. A production method of an R-T-B—C rare earth alloy (R is at least one element selected from the group consisting of rare earth elements and yttrium, T is a transition metal including iron as a main component, B is boron, and C is carbon) comprising the steps of:

preparing an R-T-B magnet containing a resin component;

preparing a solvent alloy containing a rare earth element R and a transition metal element T, ratio of said transition metal clement T being between 50 percent and 95 percent by weight, inclusive; and melting the R-T-B magnet together with the solvent alloy;

wherein said R-T-B magnet and said solvent alloy are mixed at a ratio of 5:95 to 80:20, inclusive, by weight.

2. The production method of the R-T-B—C rare earth alloy of claim 1, wherein the R-T-B magnet is an R-T-B bonded magnet and/or an R-T-B sintered magnet.

3. The production method of the R-T-B—C rare earth alloy of claim 2, wherein the R-T-B sintered magnet includes a resin film formed on the surface thereof.

4. The production method of the R-T-B—C rare earth alloy of any one of claims 1 to 3, wherein the solvent alloy contains the rare earth element R of 0.5% or more and 50% or less by weight of the total of the alloy.

5. The production method of the R-T-B—C rare earth alloy of claim 1, wherein the solvent alloy contains B (boron) and/or C (carbon), and a total content of B (boron) and C (carbon) is 0.0 1% or more and 20% or less by weight of the total of the alloy.

6. The production method of thy R-T-B—C rare earth alloy of claim 1, wherein the solvent alloy contains at least one additive element selected from the group consisting of Al, Si, P. S, Ti, V, Cr, Mn, Ni, Cu, Zn, Ga, Zr, Nb, Mo, In, and Sn.

7. The production method of the R-T-B—C rare earth alloy of claim 1, wherein the R-T-B magnet is recovered as a defective product generated in a production process, or a spent product.

8. The production method of the R-T-B—C rare earth alloy of claim 1, wherein the step of melting the R-T-B magnet together with the solvent alloy is performed in a vacuum or inert gas atmosphere by using a high-frequency induction melting method.

9. A production method of an R-T-B—C rare earth alloy comprising the steps of:

preparing an R-T-B magnet including powder of the R-T-B—C rare earth alloy produced by the production method of claim 1;

preparing a solvent alloy containing a rare earth element R and a transition metal element T; and melting the R-T-B magnet together with the solvent alloy.

10. A production method of an R-T-B—C rare earth rapidly quenched alloy magnet comprising the steps of;

preparing the R-T-B—C rare earth alloy produced by the production method of claim 1;

preparing a molten alloy of the R-T-B—C rare earth alloy; and rapidly quenching the molten alloy, thereby producing a rapidly solidified alloy.

11. The production method of the R-T-B—C rare earth rapidly quenched alloy magnet of claim 10, wherein before the step of quenching the molten alloy of the R-T-B—C rare earth alloy, a rare earth element and/or a transition metal element is added to the R-T-B—C rare earth alloy.

12. The production method of the R-T-B—C rare earth rapidly quenched alloy magnet of claim 10 or 11, wherein before the step of quenching the molten alloy of the R-T-B—C rare earth alloy, B (boron) and/or C (carbon) is added to the R-T-B—C rare earth alloy.

13. The production method of the R-T-B—C rare earth rapidly quenched alloy magnet of claim 10, wherein before the step of quenching the molten alloy of the R-T-B—C rare earth alloy, a rare earth alloy is added to the R-T-B—C rare earth alloy.

14. The production method of the R-T-B—C rare earth rapidly quenched alloy magnet of claim 10, wherein the step of producing the rapidly solidified alloy includes a step of rapidly quenching the molten alloy by bringing the molten alloy into contact with a surface of a rotating cooling member.

15. A production method of a bonded magnet comprising the steps of:

preparing powder obtained by pulverizing the alloy for the R-T-B—C rare earth magnet produced by the production method of claim 10; and mixing the powder with a resin.

* * * * *